US009227883B2

(12) United States Patent
Sippel et al.

(10) Patent No.: US 9,227,883 B2
(45) Date of Patent: Jan. 5, 2016

(54) MECHANICALLY ACTIVATED METAL FUELS FOR ENERGETIC MATERIAL APPLICATIONS

(71) Applicants: Travis R. Sippel, Ames, IA (US); Steven F. Son, West Lafayette, IN (US); Lori J. Groven, Rapid City, SD (US)

(72) Inventors: Travis R. Sippel, Ames, IA (US); Steven F. Son, West Lafayette, IN (US); Lori J. Groven, Rapid City, SD (US)

(73) Assignee: Purdue Research Foundation, West Lafayette, IN (US)

( * ) Notice: Subject to any disclaimer, the term of this patent is extended or adjusted under 35 U.S.C. 154(b) by 97 days.

(21) Appl. No.: 13/955,926

(22) Filed: Jul. 31, 2013

(65) Prior Publication Data

US 2014/0034197 A1 Feb. 6, 2014

Related U.S. Application Data

(60) Provisional application No. 61/677,609, filed on Jul. 31, 2012, provisional application No. 61/677,878, filed on Jul. 31, 2012.

(51) Int. Cl.

| | |
|---|---|
| ***C06B 45/00*** | (2006.01) |
| ***C06B 45/18*** | (2006.01) |
| ***C06B 25/00*** | (2006.01) |
| ***D03D 23/00*** | (2006.01) |
| ***D03D 43/00*** | (2006.01) |
| ***C06B 27/00*** | (2006.01) |

(52) U.S. Cl.

CPC ..... *C06B 45/18* (2013.01); *C06B 27/00* (2013.01)

(58) Field of Classification Search

USPC ..... 149/3, 2, 87, 108.2, 109.6

See application file for complete search history.

(56) References Cited

U.S. PATENT DOCUMENTS

| | | | | |
|---|---|---|---|---|
| 3,441,455 | A | 4/1969 | Woods et al. | |
| 4,017,342 | A | 4/1977 | Geisler et al. | |
| 6,843,868 | B1 | 1/2005 | Fawls et al. | |
| 7,524,355 | B2 | 4/2009 | Dreizin et al. | |
| 2010/0032064 | A1 * | 2/2010 | Dreizin et al. | 149/37 |

OTHER PUBLICATIONS

D.T. Osborne et al, "Effect of Al Particle Size on the Thermal Degradation of Al/Teflon Mixtures", Combustion Science and Technology, 2007, 179, pp. 1467-1480.

T.R. Sippel et al, "Combustion and Characterization of Nanoscale Aluminum and Ice Propellants", 44th AIAA/ASME/ASE/ASEE Joint Propulsion Conference and Exhibit, Hartford, CT. Jul. 20-23, 2008, AIAA 2008-5040.

Losada et al., "Theoretical Study of Elementary Steps in the Reactions Between Aluminum and Teflon Fragments Under Combustive Environments", Jnl of Phys.Chem.A., 2009, v.113, pp. 5933-594126.

Zamkov et al., "Ultrafast Chemistry of Nanoenergetic Materials Studied by Time-Resolved Infrared Spectroscopy: Aluminum Nanoparticles in Teflon", Jnl Phys.Chem.C., 2007, v. 1 1, pp. 10278-10284.

(Continued)

*Primary Examiner* — James McDonough

(74) *Attorney, Agent, or Firm* — Pauley Erickson & Kottis

(57) ABSTRACT

The invention provides mechanically activated metal fuels for energetic material applications. An exemplary embodiment involves mechanically treating micrometer-sized particles of at least one metal with particles of at least one fluorocarbon to form composite particles containing the at least one metal and the at least one fluorocarbon.

10 Claims, 8 Drawing Sheets

(56) References Cited

OTHER PUBLICATIONS

T.R. Sippel et al., "Altering Reactivity of Aluminum with Selective Inclusion of Polytetrafluoroethylene through Mechanical Activation", Propellants, Explosives, Pyrotechnics 2013, v. 38. pp. 286-295.
Y. Aly et al;, "Aluminum-Metal Reactive Composites", Combustion Science and Techn., Sep. 14, 2011, pp. 1107-1131, v.183:10.
V. Arkhipov et al., "The influence of aluminum powder dispersity on composite solid propellants ignitability by laser radiation", Combustion and Flame, 2012, pp. 409-415, v. 159.
C.M. Beighley et al., "Advanced Fuels and Oxidizers", "Propellants Manufacture, Hazards, and Testing", 1969, pp. 316-343, American Chemical Society, Washington DC.
A. Dohkan et al., "The Effects of Al Particle Size on the Burning Rate and Residual Oxide in Aluminized Propellants", 37th AIAA/ASME/SAE/ASEE Joint Propulsion Conference and Exhibit, 2001, pp. 1-12, AIAA, Reston VA.
A. Dohkan et al., "The Effects of Bimodal Aluminum With Ultrafine Aluminum on the Burning Rates of Solid Propellants", Proceedings of the Combustion Institute, 2002, pp. 2939-2946, v. 29.
A.Y. Dolgoborodov et al., "Detonation in an Aluminum-Teflon Mixture", JETP Letters, 2005, pp. 311-3104, v. 81 No. 7.
A.Y. Dolgoborodov et al., "Explosive Compositions Based on the Mechanoactivated Metal-Oxidizer Mixtures", Russian Journal of Physical Chemistry B, 2007, pp. 606-611, v.1 No. 6.
E. Dreizin, "Metal-based reactive nanomaterials", Progress in Energy and Combustion Science, 2009, pp. 141-167, v. 35.
R.L. Geisler, "A Global View of the Use of Aluminum Fuel in Solid Rocket Motors", 38th AIAA/ASME/SAE/ASEE Joint Propulsion Conference & Exhibit, Jul. 7-10, 2002, pp. 0-8 AIAA 2002-3748.
K. Jayaraman et al., "Quench collection of nano-aluminium agglomerates from combustion of sandwiches and propellants", Proceedings of the Combustion Institute, 2011, pp. 1941-1947, v. 33.
E.C. Koch, "Review on Pyrotechnic Aeriel Infrared Decoys", Propellants, Explosives, Pyrotechnics, 2001, pp. 3-11, v. 26.
E.C. Koch, "Metal-Halocarbon Pyrolant Combustion", The Handbook of Combustion, 2010, pp. 355-365, v. 5, ISBN: 978-3-527-32449-1.
M.L. Pantoya et al., "The influence of alumina passivation on nano-Al/Teflon reactions", Thermochimica Acta, 2009, pp. 109-110, v. 493.
D.A. Reese et al., "Intermetallic Compounds as Fuels for Composite Rocket Propellants", 47th AIAA/ASME/SAE/ASEE Joint Propulsion Conference & Exhibit, Jul. 31-Aug. 3, 2011, pp. 1-6, AIAA 2011-5865.
Z. Sarbak, "Effect of Fluoride and Sodium Ions on Structural and Thermal Properties of γ-Al2O3", Cryst. Res. Technol., 1997, pp. 491-497, v. 32.
M. Schoenitz et al., "Preparation of Energetic Metastable Nano-Composite Materials by Arrested Reactive Milling", Mat. Res. Soc. Symp. Proc., 2004, pp. AA2.6 1-AA2.6.6, v. 800.
M. Schoenitz et al., "Fully dense nano-composite energetic powders prepared by arrested reactive milling", Proceedings of the Combustion Institute, 2005, pp. 2071-2078, v. 30.
A.N. Sterletskii et al., "Structure of Mechanically Activated High-Energy Al +Polytetrafluoroethylene Nanocomposites", Colloid Journal, 2009, pp. 852-860, v. 71 No. 6.
C. Suryanarayana, "Mechanical alloying and milling", Progress in Materials Science, 2001, pp. 1-184, v. 46.
L. Takacs, "Metal-Metal Oxide Systems for Nanocomposite Formation by Reaction Milling", NanoStructured Materials, 1993, pp. 241-249, v. 2.
L. Takacs, "Self-sustaining reactions induced by ball milling", Progress in Materials Science, 2002, pp. 355-414, v. 47.
M.A. Trunov et al., "Effect of polymorphic phase transformations in Al2O3 film on oxidation kinetics of aluminum powders", Combustion and Flame, 2005, pp. 310-318, v. 140.
K.W. Watson et al., "Fast reactions with nano- and micrometer aluminium: A study on oxidation versus fluorination", Combustion and Flame, 2008, pp. 619-634, v. 155.
J.D.E. White et al., "Thermal Explosion in Al-Ni System: Influence of Mechanical Activation", J.Phys.Chem. A, 2009, pp. 13541-13547, v. 113.
R.A. Yetter et al., "Metal particle combustion and nanotechnology", Proceedings of the Combustion Institute, 2009, pp. 1819-1838, v. 32.
P. Zoller, "The Specific Volume of Poly(tetrafluorethylene) as a Function of Temperature (30-372C) and Pressure (0/2000 kg/cm2)", Journal of Applied Polymer Science, 1978, pp. 633-641, v. 22.
O. Schulz et al., "Structural changes during the oxidation of micrometer-sized Al particles up to 1523 K in air", Z. Kristallogr. Proc., 2011, v. 1, pp. 367-372.
L. Fried et al., "Cheetah: A Next Generation Thermochemical Code", Lawrence Livermore National Laboratory, Nov. 1994, UCRL-ID-117240.

* cited by examiner

MECHANICALLY ACTIVATED METAL FUELS FOR ENERGETIC MATERIAL APPLICATIONS

CROSS REFERENCE TO RELATED APPLICATIONS

This application claims priority to U.S. Provisional Patent Application 61/677,609, filed 31 Jul. 2012, and entitled "Mechanically Activated Metal Fuels for Energetic Material Applications", and U.S. Provisional Patent Application 61/677,878, filed 31 Jul. 2012, and entitled "Tunable Aluminum-Fluorocarbon Reactive Particles". These priority applications are hereby incorporated by reference herein and made a part hereof, including but not limited to those portions which specifically appear hereinafter.

STATEMENT REGARDING FEDERALLY SPONSORED RESEARCH OR DEVELOPMENT

This invention was made with government support under FA9550-09-01-0073, awarded by the United States Air Force Office of Scientific Research (AFOSR). The government has certain rights in the invention.

FIELD OF THE INVENTION

This invention generally pertains to the field of metal fuels and, more specifically, to metal fuels such as used in energetic material applications. In accordance with certain selected aspects, the invention more particularly relates to mechanically activated metal fuels such as may be used in energetic material applications, for example.

This invention also generally pertains to the field of metal fuel and fluorocarbon-containing composites. In accordance with certain selected aspects, the invention more particularly relates to aluminum and fluorocarbon-containing reactive particles such that desirably demonstrate or exhibit increased or improved tunability.

BACKGROUND OF THE INVENTION

Metallic or metalloid fuels powders such as aluminum, boron, magnesium, silicon, lithium and alloys or combinations thereof have found use in various energetics including, for example, propellants, pyrotechnics and explosives. Aluminum has become one of the most frequently used metallic fuels in such energetics, yet its efficient use in these energetics remains challenging for several reasons. For example, in the use of micrometer sized aluminum in propellants, the relatively high ignition temperature of aluminum and related particle agglomeration typically results in lower combustion efficiency and increased two-phase flow losses, e.g., slag formation.

To overcome or combat these drawbacks, micrometer sized aluminum has been replaced with nanosized aluminum (nAl) in experimental propellants and has resulted in improved performance (e.g., shorter particle burning time, reduced metal agglomeration, decreased ignition delay, reduced condensed product size, and anticipated increases in propellant heat feedback).

For example, U.S. Pat. No. 7,524,355 and U.S. Patent Application Publication 2010/0032064 disclose nano composite energetic powders, such as composed of aluminum and a metal oxide oxidizer, prepared by what is termed "arrested reactive milling" and such as exemplified by high energy milling.

Unfortunately, the utility of nanosized aluminum is significantly reduced as such materials can exhibit a high oxide content and a high surface area (10-50 $m^2/g$) that can lead to various processing issues.

Conventional aluminized solid propellant is a physical mixture of fuel (typically aluminum, boron, magnesium, silicon, or alloys thereof) particles and oxidizer (typically ammonium perchlorate (AP), ammonium nitrate, potassium perchlorate, etc.). These particles are combined in a cured rubber-based binder matrix, or other polymer composite. When the propellant burns, the solid surface composed of these materials regresses. The binder burns with the oxidizer, exposing metal particles, which once exposed, light and burn in the surrounding hot, oxygenated gas environment. Combustion of metal in this way is limited by the rate at which oxidizer gases can be diffused to the metal surface. As such, reaction rates can generally be improved by increasing metal-gas interface surface area. Furthermore, reaction of metal with oxidizer can create a partial metal oxide coating or "cap" on the surface of molten, burning metal, which further hinders the metal-oxygen reaction by forming a diffusive barrier at the surface of the burning particle. A second way in which metal combustion is hindered is related to the melting and agglomeration of conventional metal particles. Melting, which typically occurs at the propellant surface hinders reaction because molten metal particles tend to agglomerate together, reducing metal-oxidizer interfacial surface area. Furthermore, the time delay between when metal particles begin to melt and when they reach the ignition temperature provides molten particles ample time to coalesce and create larger agglomerates with lower specific surface area. These two problems, (1) the formation of a partial oxide layer on reacting particle surfaces and (2) the agglomeration of molten metal particles represent two significant deficiencies regarding metal combustion in a solid rocket motor.

Fluorocarbons are of particular interest for inclusion with aluminum and have been proposed in a variety of applications including reactive liners/fragments, heterogeneous explosives, and infrared (IR) flares. While fluorocarbons such as cause or result in the formation of metal fluorides are of interest, simple addition or coating is not effective. For example, coatings typically boil from the surface of reacting particles at temperatures below the melting point of metal oxides. Attempts have previously been made to introduce fluorine into a propellant. For example, U.S. Pat. No. 4,017,342 is directed to a method for improving the combustibility of aluminum metal powders for use in solid rocket propellant formulations and requires exposing aluminum oxide coated aluminum metal powder to hydrogen fluoride gas for a period of time sufficient to effect a reaction therebetween. Thus, the exterior surfaces of aluminum particles react with fluorine (from exposure of Al to HF). While in general, higher theoretical heat release and performance are possible from the formation of metal fluorides rather than metal oxides, such an aluminum fluoride coating on particle surfaces prior to combustion results in a lower overall heat release, as the aluminum particles contain an already reacted form of aluminum. U.S. Pat. Nos. 6,843,868 and 3,441,455 detail other attempts to introduce fluorine in the form of a fluorocarbon such as either physically mixed as a powder into the propellant prior to curing of the binder or as a coating, for example.

The success of metal-fluorocarbon reactives can predominantly be attributed to a very high (volumetric and gravimetric) heat release resulting from fluorination instead of oxidation. These benefits have been realized in reactive compositions where higher performance is seen from use of fluorine-based rather than oxygen based oxidizers. For applications where high gas production is desired (such as solid propellants), the about 1000° C. lower boiling/sublimation point of most metal fluorides compared to their respective oxides can decrease formation of condensed phase product. Reaction of Al with polytetrafluoroethylene (PTFE) is of particular interest due to PTFE's high fluorine content (67 mol. %) and the composition's high enthalpy of reaction (9 kJ/g).

However, one particular drawback of metal-PTFE reactives (as well as other heterogeneous reactives) is the large diffusion distances present in micron sized mixtures.

The issue of diffusion limited combustion has been addressed by several researchers either by significant reduction of reactant particle size through use of nanoparticle reactants (e.g., nAl-nPTFE) or mechanical activation (MA). The reduced diffusion distance resulting from the use of nanoscale particles dramatically decreases the thermal stimulus required to achieve ignition. Specifically, the heating of nAl-nPTFE (70-30 wt. %) mixtures has been shown to result in an exothermic pre-ignition reaction (PIR) at about 450° C., which is about 150° C. below the primary ignition temperature of micrometer scale Al-PTFE mixtures. In addition, the significantly higher heat release seen from nAl-nPTFE has been attributed to more complete combustion. The use of MA has been successfully applied to many heterogeneous energetics, as such processing provides a top-down approach to decreasing diffusion distances and altering ignition and reaction behavior. With MA (sometimes referred to as arrested reactive milling (ARM)), the milling process is interrupted prior to reaching a critical milling energy dose sufficient to induce self-sustained reaction. The milling yields increased reactant interfacial contact and decreased diffusion distances that can exceed that which is possible with nanoscale physical mixtures, which can lead to reaction at lower temperatures.

Also, the inclusion, by MA, of low levels (10 wt. %) of a secondary metal such as Fe, Zn, or Ni in aluminum has also been shown to reduce the ignition temperature and alter the low temperature oxidation process of aluminum. The addition of secondary metals in composite propellants, however, is not always advantageous and generally results in lower predicted specific impulse (Isp).

Thus, there remains a need and a demand for methods and materials such that can desirably facilitate the incorporation of metal fuels in various applications and uses.

SUMMARY OF THE INVENTION

The present invention provides methods and processes for making mechanically activated metal fuels for energetic material applications. The present invention also provides such mechanically activated metal fuels for such applications.

In accordance with one aspect, one such method for making mechanically activated metal fuels for energetic material applications involves mechanically treating micrometer sized particles of at least one metal with particles of at least one fluorocarbon to form composite particles containing the at least one metal and the at least one fluorocarbon in unreacted form.

In accordance to another aspect, there is provided a composite of micrometer sized particles of at least one metal that have been mechanically treated with particles of at least one fluorocarbon. In such composite, the at least one metal and the at least one fluorocarbon are contained in an unreacted form.

As detailed further below, intimate reactant mixing such as afforded by low and high energy mechanical activation is exploited to produce micron scale energetic composite particles with decreased reactant diffusion distances that result in altered ignition and reaction characteristics. Further, effects of milling time and energy on the resulting particle morphology, phase and energy content are presented together with a thermal analysis that details the role of milling on the reaction characteristics in both inert and oxidizing environments.

Other objects and advantages will be apparent to those skilled in the art from the following detailed description taken in conjunction with the appended claims and drawings.

DETAILED DESCRIPTION OF THE INVENTION

Figure 1:
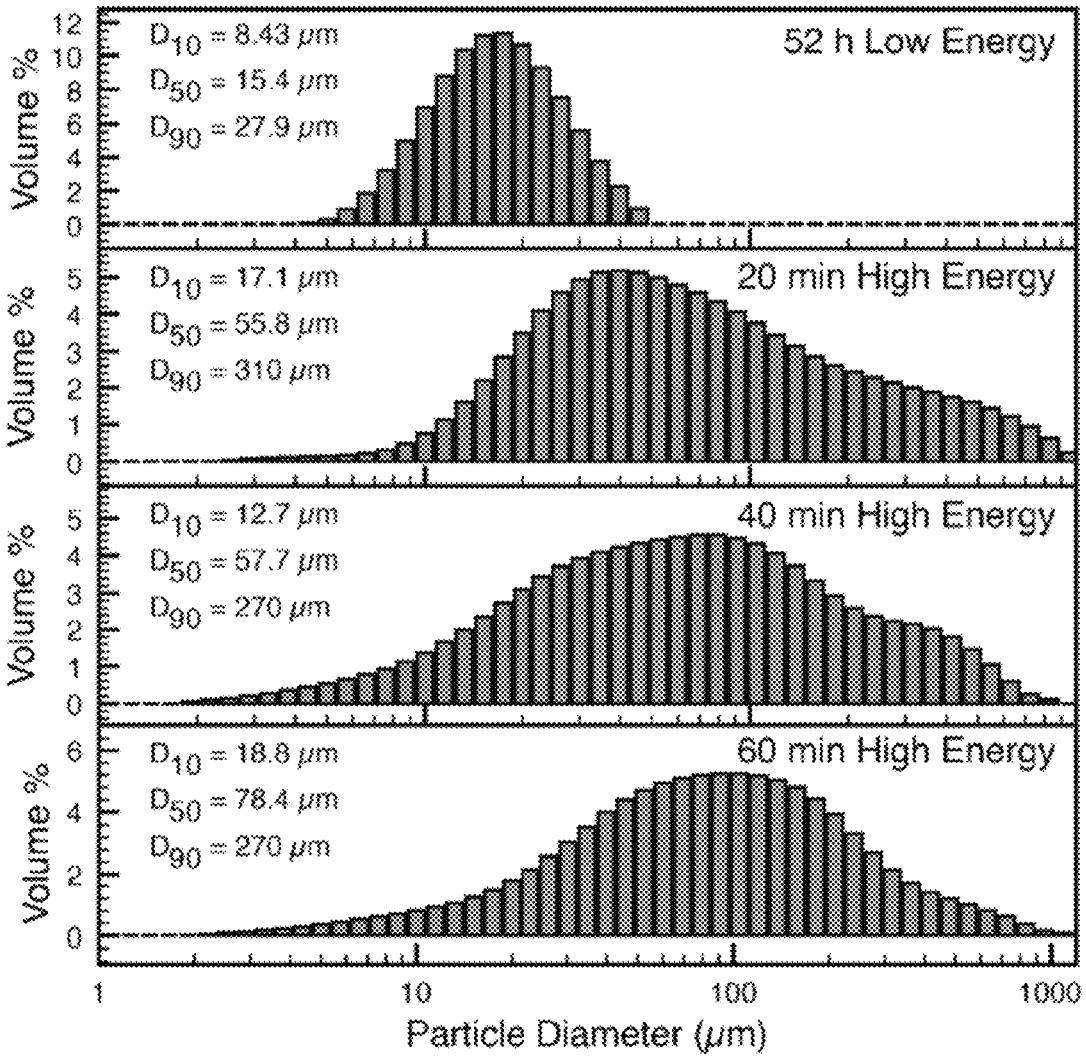
FIG. 1 is a graphical presentation of volume-weighted particle size distributions of neat and milled Al-PTFE (70-30 wt. %) composite particles in accordance with one embodiment of the invention and as described in the Examples.

The present invention provides mechanically activated metal fuels for energetic material applications. In accordance with a preferred practice of the invention, one such activated metal fuel for energetic material applications is desirably a composite of micrometer sized particles of at least one metal that have been mechanically treated with particles of at least one fluorocarbon.

Those skilled in the art and guided by the teachings herein provided will appreciate that various metal and/or metalloid fuel powder materials including, for example, aluminum, boron, magnesium, silicon, lithium, and combinations or alloys thereof, can be used as may be desired for a particular application or use. As discussed and described in greater detail below, aluminum is a metal material for use in accordance with certain preferred embodiments.

More particularly, micrometer-sized metal particles are mechanically treated with fluorocarbon particles. In accordance with one aspect of the invention, such mechanical treatment involves repeated plastic deformation of a mixture containing the micrometer sized particles of the at least one metal and particles of the at least one fluorocarbon. For example, the metal particles and the fluorocarbon particles are desirably subjected to repeated plastic deformation of a mixture containing the micrometer sized particles of the at least one metal and particles of the at least one fluorocarbon. Suitable such mechanical treatments can include or involve high-energy milling, low energy milling or any other mechanical deformation process, causing the particles to mix and weld or join together, desirably without reacting, creating composite particles comprised of both the metal and the fluorocarbon. The thoroughness of the mixing or homogeneity of the mixture of the materials has been found to lead to increased reactivity.

Moreover, it has been discovered that such mechanical treatment can desirably result in the storage of additional energy in the material through the creation of lattice defects within the structure of the material. This additional energy can in turn be released upon proper heating or combustion of the material.

Suitable fluorocarbons for use in the practice of the invention include fluorocarbons such as polytetrafluoroethylene (PTFE), poly(carbon monofluoride) (PMF), 1-chloro-1,2,2-trifluoroethene (Kel-F), terpolymers based on tetrafluoroethylene, hexafluoropropylene and vinylidene fluoride, and combinations thereof, as well as other high fluorine content materials which are typically devoid of oxygen, for example.

While the invention can be successfully practiced in embodiments employing metal particles and fluorocarbon particles that are similarly sized and typically less than 1000 microns in size (both each being 12 micron or 35 micron sized particles, for example), those skilled in the art and guided by the teaching herein provided will understand and appreciate that the broader practice of the invention is not necessarily so limited.

Similarly, while the invention can be successfully practiced in embodiments employing metal particles such as present in a relative amount of at least about 70 wt. % and fluorocarbon particles present in a relative amount of up to about 30 wt. %, those skilled in the art and guided by the teaching herein provided will also understand and appreciate that the broader practice of the invention is not necessarily so limited.

In contrast to prior attempts to include or incorporate fluorine and/or a fluorocarbon with metal particles, the present invention desirably addresses both the problem of metal oxide shell development and metal particle agglomeration. More specifically and without unnecessary limitation on the subject invention, the metal fluorocarbon composites hereof desirably differ from those here before known, provided or otherwise available in that the fluorocarbon is physically encased inside the metal particles themselves. Furthermore, because the metal-fluorocarbon reaction occurs at temperatures far lower than that of metal particle ignition, targeted heat and gas release can occur within metal particles prior to ignition. The interior heat and gas release will result in different metal combustion characteristics and can or may result in shatter of metal particles/agglomerates into smaller particles, increasing interfacial surface area and resulting in improved metal combustion. Additionally, ignition from within and at temperatures below melting can or may release an amount of energy capable of rapidly increasing particle temperature to the ignition temperature, decreasing the duration over which metal particles can agglomerate. Still further, the surface area of the reactive composite particles of the current invention can be made high in order to further improve reaction rate with gaseous, oxidizing species.

The mechanical treatment used herein to make the particles is also different than physical mixtures or coatings tried by others, as the subject mechanical treatment desirably results in more intimate mixing of fluorocarbon and fuel and allows the tunability of metal combustion. That is, longer milling time can result in lower ignition temperature as well as increased heat release. Furthermore, with metal particles such as of aluminum, the mechanical activation "treatment" process increases the amount of energy released from the metal particle combustion by creating lattice defects. Upon heating, at low temperatures, these lattice defects anneal or repair, releasing what can be a substantial amount of heat at low temperatures. The heat release from lattice defect repair is in excess of the heat release typically available from breaking of chemical bonds. Those skilled in the art and guided by the teachings herein provided will understand and appreciate that other uses of lattice defects as a means to store and release additional energy in energetic materials may be possible and such uses are not necessarily limited to those described above.

In accordance with particular embodiments, fuel rich aluminum-polytetrafluoroethylene (Al-PTFE) (70-30 wt. %) reactive particles were formed in accordance with the invention by high and low energy milling processes. Average particle sizes ranged from 15-78 μm and specific surfaces areas ranged from about 2-7 $m^2/g$. The heat of combustion was about 23.4 kJ/g.

The invention shows that mechanical activation (MA) treatment of fuel-rich Al-PTFE mixtures can result in micron sized Al-PTFE composite particles with disrupted ignition barriers and increased reactivity. It has been discovered that the use of MA results in mixing of reactants with reaction behavior similar to that of nanosized aluminum-nanosized PTFE (nAl-nPTFE). Notably, high or low energy MA results in significant reduction of exotherm onset from 600° C. to 450° C. in anaerobic heating and from 550° C. to 450° C. in presence of $O_2$. For composite particles formed with high energy MA, differential scanning calorimetry in $O_2$—Ar indicates that, unlike physical mixtures or those particles formed under low energy MA, complete reaction occurs at higher heating rates; the reaction onset is drastically reduced (about 470° C.). Furthermore, results suggest that at aerobic heating rates greater than 50° C./min, near complete heat release occurs by about 600° C. instead of at higher temperatures.

In addition to having significantly altered reaction behavior, the enthalpy of combustion of MA particles was found to be as high as 23.4 kJ/g, which is nearly 70% higher than the measured combustion enthalpy of nAl-nPTFE mixtures. Additionally, the large (e.g., about 15 to 78 μm) average particle size and moderate specific surface areas (e.g., 2 to 7 $m^2/g$) of composite particles are more useful than nanoparticles in high solid loaded energetics and may age more favorably than nanoparticle mixtures. Further reduction of particle specific surface area and improvement of aging characteristics may be achieved by adding a small amount of binder (e.g., Viton A) during the milling process or through crash deposition after MA particle formation. A lower fraction of PTFE may also prove to be advantageous for some applications.

Micron sized activated fuel particles, with altered ignition and reaction characteristics; such as herein provided are advantageous alternatives to nanoparticle solid propellant additives such as nAl. With these particles, similar propellant performance increases can be achieved with less detriment to propellant mechanical and rheological properties. Further, when used as a replacement for micrometer aluminum in solid propellants, these particles may ignite far below the ignition temperature of micron aluminum (>2000° C.) and they can decrease ignition delay, agglomerate size, and reduce condensed phase losses as well as lead to increased heat release and higher burning rates.

Thus, in accordance with one aspect of the invention, a metallic or metalloid fuel powder such as aluminum, boron, magnesium, silicon, lithium, or an alloy thereof and a fluorocarbon such as polytetrafluoroethylene (PTFE or TEFLON) are mechanically treated in the presence of each other using a roller mill or any other impact or deformation process resulting in deformation, cold welding, and mixing of powders. The resulting powder particles are heterogeneous in composition and contain both fuel and fluorocarbon. This resulting material has thermal behaviors far different than micrometer or nanometer sized physical mixtures of the same starting materials. Further, this resulting material is capable of undergoing exothermic reaction at temperatures in excess of 100° C. below reaction temperatures of corresponding physical mixtures. Still further, this resulting material can desirably be able to gravimetrically release more heat than is possible from complete chemical reaction of the constituents due to the storage and release of energy from lattice defects created by the mechanical activation process.

These modified heterogeneous particles can be used in place of untreated metal particles in an energetic application such as in a solid rocket motor. The particles can be mixed with an oxidizer, such as ammonium perchlorate, possibly a binder, possibly one or more additional metal(s), etc. to form a composite energetic material. The final mixture can, if desired, be subsequently cast or extruded prior to use. The final solid will desirably possess superior performance properties and can be ignited by means of an igniter charge or other energy source.

In accordance with another aspect of the invention, heterogeneous particles such as described above can be mixed with a secondary explosive such as HMX, RDX, CL-20, or other, for example. A binder material could then be added and the mixture can be pressed/formed or can be mixed with a solvent and/or extruded/cast/cured. The final resulting solidified charge can then be conventionally initiated such as via a primary explosive. Because the modified fuel particles would ignite and burn easily with surrounding air, the resulting explosive could be expected to provide or exhibit enhanced blast properties.

In accordance with another aspect of the invention, heterogeneous particles such as described above can be mixed with a fuel, such as a polymeric binder, and formed into a solid fuel grain by a cast/cure, extrusion processing, or pressing, for example. The cured fuel grain would desirably possess superior performance properties and may be reacted with flowing oxidizer, such as in a hybrid rocket configuration.

In accordance with another aspect of the invention, heterogeneous particles such as described above are mixed with an oxidizer such as ammonium perchlorate, ammonium nitrate, potassium perchlorate, or other, for example, such as to create a pyrotechnic mixture. The pyrotechnic mixture can be pressed with or without a binder or mixed with a curable binder. The energetic mixture can be ignited by a thermal energy source.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

Experimental

Mechanically activated composite particles were produced using either low energy or high energy milling methods. Low energy milled composite particles were produced in about 3 g batches composed of 70 wt. % aluminum (35 μm, Valimet H30) and 30 wt. % polytetrafluoroethylene (PTFE) (35 μm, SigmaAldrich 468096). Mixtures were milled inside argon-filled, 125 mL high density polyethylene (HDPE) bottles (VWR 414004-156) with a US Stoneware roller mill rotating at 290 revolutions per minute (RPM). A charge ratio of 70 was used with 75 wt. % 0.95 cm (McMaster-Carr 9529K19) and 25 wt. % 0.188 cm (McMaster 9529K13) 440C steel media. Fuel-rich mixtures of 70 wt. % Al were chosen to i) improve overall safety compared to more stoichiometric mixtures, and ii) allow direct comparison to previous nAl-nPTFE results. For comparative purposes, physical mixtures of Novacentrix 50 nm nAl and Dupont Zonyl (MP1110) nanoscale PTFE (nPTFE) were mixed following the procedure of D. T. Osborne, M. L. Pantoya, Effect of Al Particle Size on the Thermal Degradation of Al/Teflon Mixtures, *Combustion Science and Technology*. 2007, 179, 1467-1480.

High energy mechanical activation (MA) particles were produced by milling about 1 g Al-PTFE batches (70-30 wt. %) in 30 mL HDPE containers (Cole Parmer EW 06034-51) using a charge ratio of 24 (73 wt. % 0.95 cm, 27 wt. % 0.188 cm media). Milling containers were filled with argon prior to milling on a SPEX 8000 high energy mill using a duty cycle of 1 min on, 4 min off. During milling, the milling container was cooled using a fan. All milled materials were handled in an argon-filled glove box and were passivated prior to use by adding enough hexane to fully cover the particle and slowly evaporating the hexane in air. The milling duration (degree of milling treatment) was selected based on the critical milling time required to initiate reaction. The temperature of the milling container was monitored during the milling operation by affixing a K-type precision thermocouple (Omega 5SC-TT-K-36-36) to the exterior of the milling container and recording temperature (Omega OM-EL-USB-TC-LCD). Thermocouple data was also used to determine the critical milling time of mixtures.

A Broker D8-Focus powder X-ray diffractometer (Cu-Kα) was used to analyze composite particles using a scan rate of 2°/min. Scanning electron microscopy (SEM) and energy dispersive spectroscopy (EDS) were conducted using a FEI Quanta 3D-FEG. Particles were also encased in epoxy and sectioned with a Reichert Ultracut E ultramicrotome for imaging of the particle interior. A Micromeritics Tristar 3000 surface area analyzer was used to measure specific surface area. The samples (about 80 mg) were degassed at 50° C. in ultra-high purity nitrogen for 18-hrs prior to analysis. Average particle size was assessed using a Malvern Mastersizer 2000 with Hydro 2000 μP dispersant unit with hexane as the dispersing medium.

Thermal behavior of 3-10 mg samples was determined in a TA Instruments Q600 differential scanning calorimetry-thermogravimetric analysis (DSC-TGA) over a temperature range of 100 to 800° C. with heating rates ranging from 5 to 50° C./min and 100 mL/min flow of either ultra high purity argon or a mixture of 20 vol. % $O_2$—Ar. Composite enthalpies of combustion were determined using a Parr 1281 oxygen calorimeter with $O_2$ pressure of 3.10 MPa (450 psi) and a 350 mL chlorine-resistant pressure vessel (Parr 1136CL). Prior to ignition, powders were pressed into about 50 mg pellets of 3 mm diameter and about 50% maximum density. Pellets were burned in a custom-made alumina-silicate crucible. For each material, four separate tests were conducted and averaged. The computed "maximum" heat of combustion was determined for compositions in 99 wt. % $O_2$ using the Cheetah 6.0 equilibrium code.

Electrostatic discharge (ESD), impact, and friction sensitivity tests were conducted on 52 hr low energy and 60 min high energy MA composite powders. For all sensitivity tests, the Neyer Software was used to determine ignition probability as a function of stimulus strength. Electrostatic discharge testing was conducted on approx. 8 mg powder samples using a custom made apparatus described in Sippel et al., Combustion and Characterization of Nanoscale Aluminum and Ice Propellants, 44th *AIAA/ASME/ASE/ASEE Joint Propulsion Conference and Exhibit*, Hartford, Conn., USA, Jul. 20-23, 2008, AIAA 2008-5040. The ESD machine was operated in oscillatory mode with a 0.1 pF capacitance and variable discharge voltage ranging from 100 to 10,000 VDC. Measurements were made inside an environmental box held at 33±2% relative humidity by a saturated salt solution. Twenty tests were conducted with each material in order to determine a 50% ignition threshold.

Impact sensitivity experiments were conducted on 10 mg samples using a 5.0 kg weight dropped from various heights. The detailed procedure and test apparatus used are described in Sippel et al., Combustion and Characterization of Nanoscale Aluminum and Ice Propellants. The MA composite powder was placed on 180-grit sand paper inside a confinement chamber. The chamber pressure was recorded during the test using a PCB (102M232) dynamic pressure transducer and oscilloscope. Ignition was indicated by one or a combination of pressure signal, audible report, and/or presence of combustion products in the chamber. Friction tests were conducted on 3 mg powder samples using a BAM (Bunde-sanstalt für Materialforschung) friction tester.

TABLE 1

Specific surface areas of Al-PTFE (70-30 wt. %) neat and MA composite particles.

| Material/Milling time | BET SSA/$M^2$/g | 50% ESD ignition threshold/mJ |
|---|---|---|
| Physical mixture | 0.048 ± 0.025 | — |
| 52 h Low energy | 3.2 ± 0.1 | 108 |
| 20 min High energy | 6.7 ± 0.2 | — |
| 40 min High energy | 5.6 ± 0.1 | — |
| 60 min High energy | 2.0 ± 0.1 | 89.9 |

Results & Discussion

While both high and low energy milling were found to be amenable to producing intimately mixed Al-PTFE (70-30 wt. %) composite particles with reactivity similar to that of nAl-nPTFE physical mixtures, the necessary MA duration was quite different for the two milling methods. High energy milling times in excess of 60 min MA were sufficient to initiate reaction during milling, while a low energy critical milling time was not reached even at 52 hrs. In general, thermal and morphological properties of milled composite particles were repeatable but sensitive to milling conditions specifically high energy milled materials were sensitive to cooling time and fan speed, as reduction of milling cycle cooling time from 4 to 1 min decreased the critical milling time to about 35 min and a similar effect was observed in milling without fan cooling. With 60 min MA, the resulting Al-PTFE composite particles are pyrophoric and require passivation by gradual exposure to air.

The specific surface areas of composite particles (Table 1) ranged from 2.0 to 6.7 $m^2$/g and show that increased cold welding occurred with longer duration high energy milling, and resulted in lower specific surface area. This decrease in specific surface area coincides with the increase in average particle size observed from volume weighted particle size distributions obtained from forward light scattering measurements. These results, shown in FIG. 1, indicate particle size distributions of milled particles are log normal and the average particle size of high energy milled materials increases from 55.8 μm (20 min MA) to 78.4 μm (60 min MA). The particle size distributions of high energy milled materials are broad and positively skewed, while the size distribution of low energy milled (52-hr) particles is highly uniform with an average particle size of 15.4 μm. Scanning electron microscopy and the significantly smaller average particle size and comparable specific surface area of low energy milled particles revealed that these particles were flake-like in morphology and indicated that the surface of low energy milled particles was smoother and contained fewer surface features. The higher specific surface area of high energy milled particles is expected to be a result of the higher energy milling method, which leads to strain hardening of the aluminum matrix and reduced cold welding efficiency at longer milling times.

Figure 2:
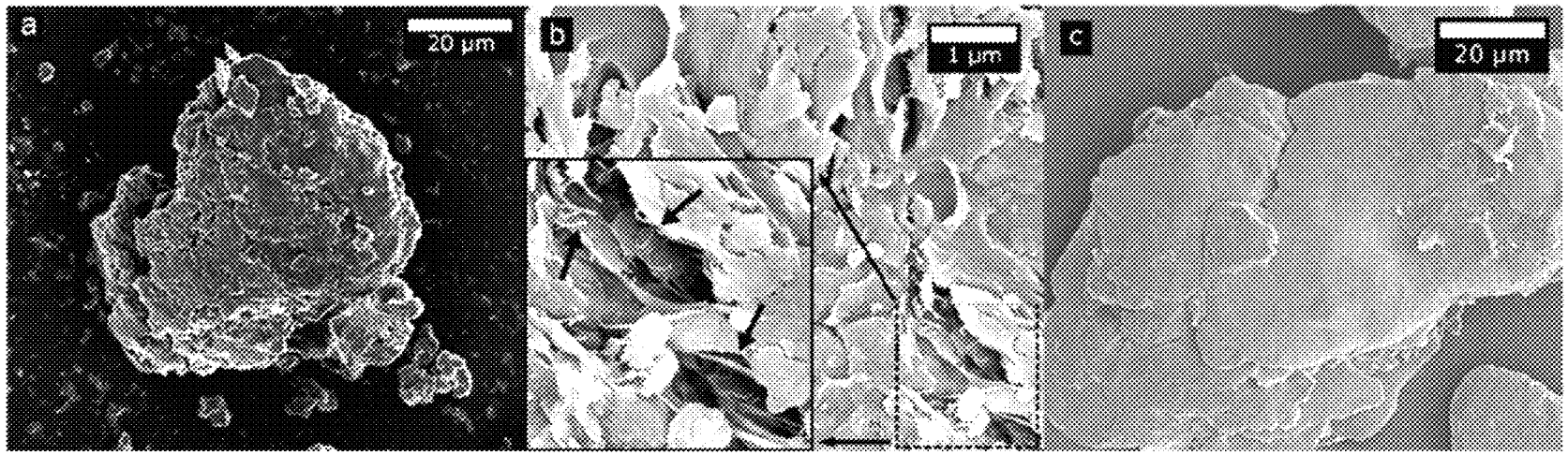
FIG. 2 is SEM micrographs of (a) single 60 min high energy MA particle, (b) 60 min high energy MA particle interior structure and inset detail, and (c) single 52 hr low energy MA particle, in accordance with embodiments of the invention. Black arrows indicate PTFE fibers.
Figure 3:
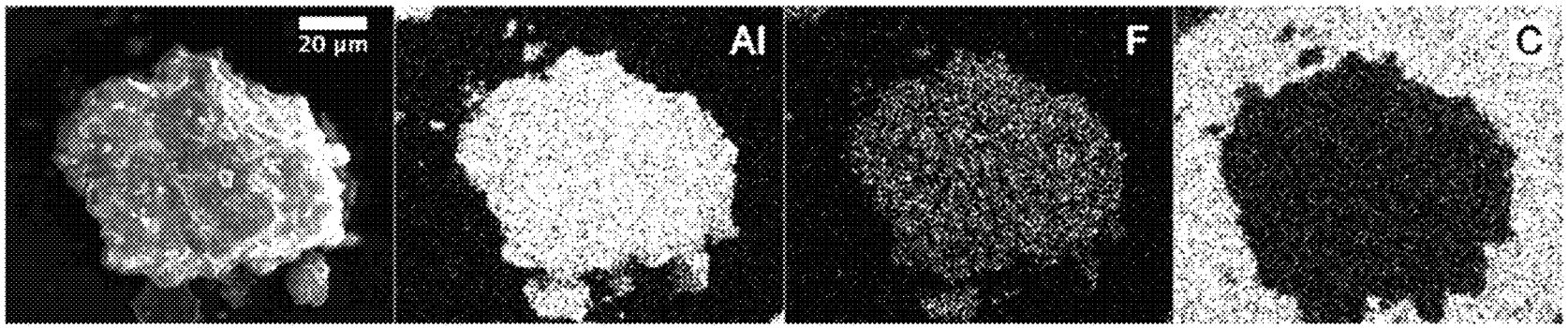
FIG. 3 is SEM micrograph of 60 min high energy (SPEX) milled Al-PTFE (70-30 wt. %) particle (left) and EDS elemental map (right) of the particle showing presence of aluminum (Al), fluorine (F), and carbon (C), in accordance with embodiments of the invention.

Effects typical of strain hardening were also observed in SEM images of a high energy MA particle (FIG. 2*a*), where incomplete cold welding produced voids, cleaved surfaces, and incompletely consolidated flakes on the particle surface. While individual particles remain in the range of about 20-300 μm, at 60 min MA, the decreased aluminum cold welding efficiency resulted in a highly cleaved surface and visible pockets. SEM images indicate that cold welding and subsequent strain hardening was less pronounced at lower MA times and for low energy MA. In the initial stages of milling, the milling mechanism is responsible for forming these composite particles to be typical of ductile-ductile milling. During this process, the more ductile material (PTFE) deformed and coated the higher yield strength material (aluminum), minimizing exposure of unoxidized metal surfaces and reducing material specific surface area. As particles were cold welded together, alternating lamellar layers of PTFE and aluminum formed within particles, to result in high reactant interfacial area. With continued milling, aluminum strain hardening occurred and the PTFE appeared frayed into about 10-50 nm diameter PTFE fibers. These fibers are evident in FIG. 2*b*, which shows the interior of a 60 min MA particle. The intimate mixing of aluminum and PTFE is apparent from EDS of a high energy milled (60 min) particle, shown in FIG. 3. Elemental analysis shows even distribution of fluorine throughout the particle's aluminum matrix, which indicates intimate Al-PTFE mixing. It is worth noting that at an accelerating voltage ≥20 kV, localized ignition of high energy MA particles occurred within the microscope.

Figure 4:
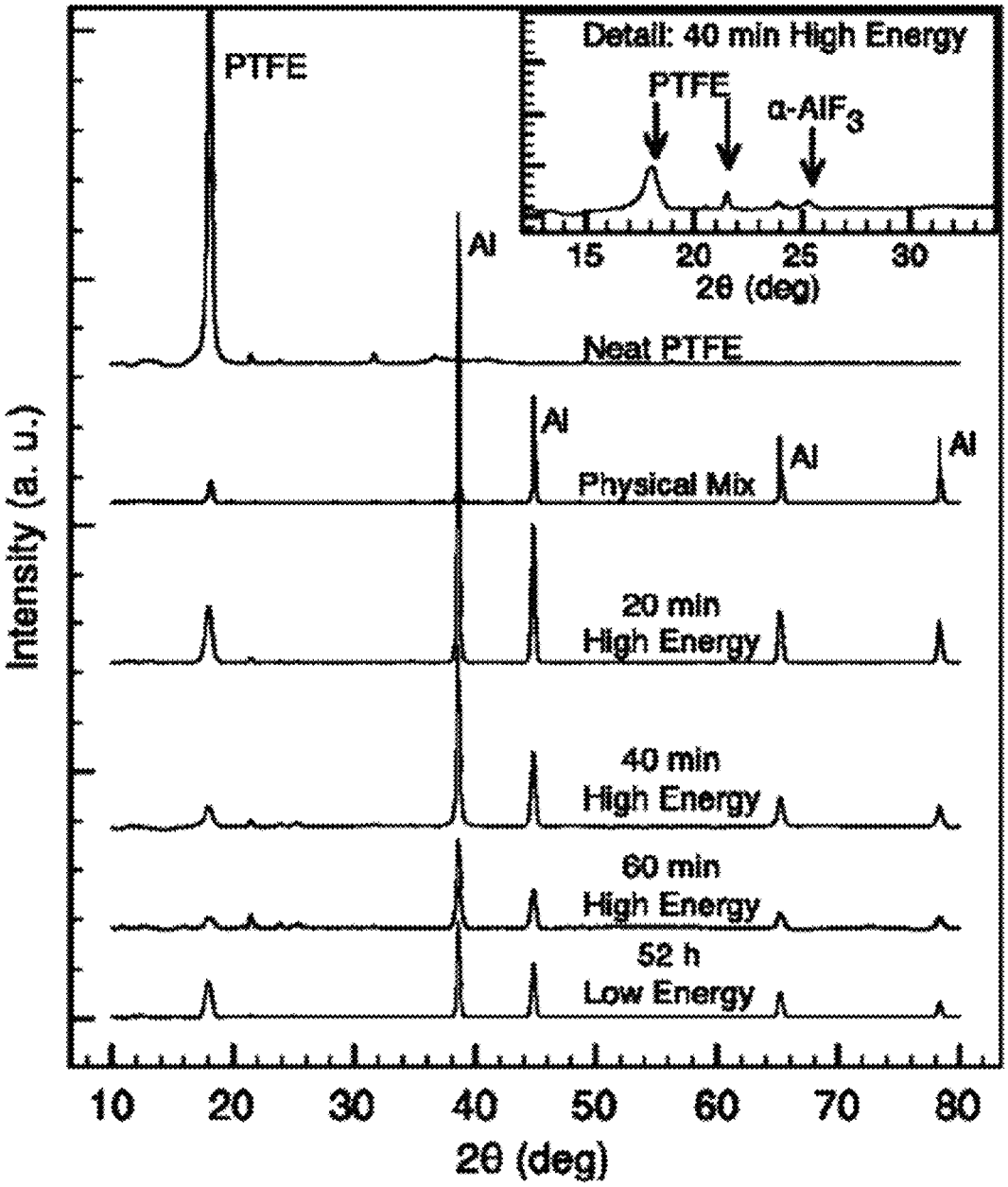
FIG. 4 is a graphical presentation of the XRD patterns of Al-PTFE (70-30 wt. %) MA particles, in accordance with embodiments of the invention, and physical mixtures.

X-ray diffraction of milled, neat, and physically mixed materials (FIG. 4) indicates substantial peak broadening as a result of both crystallite size reduction and milling induced strain. Scherrer analysis of peaks indicates 60 min high energy MA reduces aluminum crystallite size from 59 to 24 nm and PTFE crystallite size from 26 to 9 nm. With extended high energy milling, gradual formation of $\alpha$-$AlF_3$ with extended milling time can be observed. This gradual formation of product species has been observed in high energy milling of other reactive mixtures and may be caused by milling-induced reactions that occur locally at milling impact sites. However, the low impact energy of roller milling appears to be insufficient to produce detectable quantities of intermediates, as no product species were detected in diffraction data of low energy MA composites. Although the presence of $\alpha$-$AlF_3$ in high energy MA composites suggests a reduction in the energy content, oxygen calorimetry (FIG. 5) of these materials indicates the degree of $\alpha$-$AlF_3$ formation and subsequent energy reduction is minor. Increasing milling time from 20 to 60 min (high energy MA) decreased composite particle enthalpy of combustion from 22.0±0.6 to 21.1±0.9 kJ/g. The overall higher heat release of low energy milled materials (23.4±0.9 kJ/g) further suggests that $\alpha$-$AlF_3$ formation is in part responsible for the slight reduction in heat release resulting from longer duration and higher intensity milling.

Figure 5:
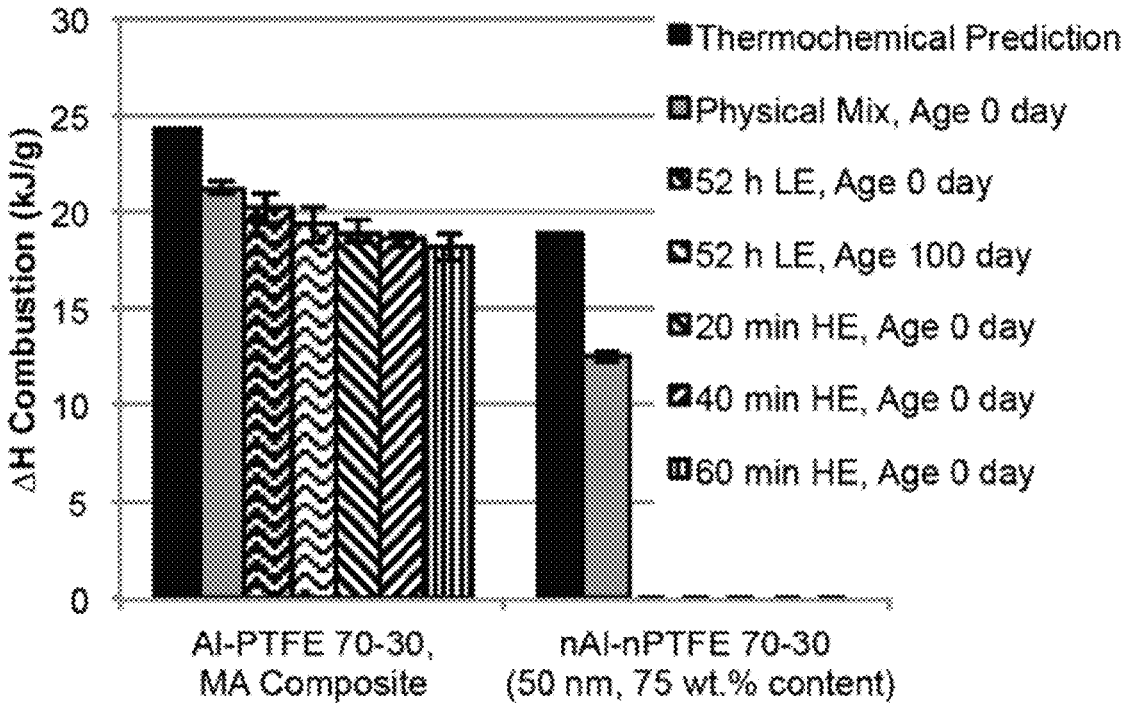
FIG. 5 is a chart of the enthalpy of combustion of Al-PTFE low energy (LE) and high energy (HE) MA particles, in accordance with embodiments of the invention, and nanoparticle mixtures. Error bars indicate the standard deviation of four tests.

The formation of some $Al_2O_3$ in these fuel rich composite particles is also expected due to initial exposure of the material to air after the MA process. However this $Al_2O_3$ was not detected by XRD due to its amorphous nature. Its presence, however, resulted in a decrease in combustion enthalpy from the maximum, computed (Cheetah) value of 24.3 kJ/g to that of low energy MA composites (23.4±0.9 kJ/g). Successive air aging of low energy MA composite particles for 100 days further reduced combustion enthalpy to 19.4±0.9 kJ/g (FIG. 5). Perhaps the most noticeable difference in combustion enthalpies, shown in FIG. 5, is between that of MA composites and similar nAl-nPTFE physical mixtures. Due to the lower aluminum oxide content of MA composites, the computed (Cheetah) enthalpy of combustion of MA composite particles (0 wt. % $Al_2O_3$, $\Delta H_c$=24.3 kJ/g) is about 30% higher than the computed enthalpy of combustion of nAl-nPTFE physical mixtures (25 wt. % $Al_2O_3$, $\Delta H_c$=18.9 kJ/g) and nearly 70% higher than the measured nAl-nPTFE combustion enthalpy (14.6±0.3 kJ/g). The difference between measured nAl-nPTFE enthalpy of combustion and the computed value could be due to a combination of manufacturer batch variation, poor mixing of nAl-nPTFE mixtures during sonication and drying, or settling of mixtures during handling.

In addition to MA composites having combustion enthalpies higher than nAl-nPTFE, the MA process altered reactivity from that of micrometer precursor mixtures, resulting in materials with ignitability and reaction characteristics similar to those of nAl-nPTFE physical mixtures without the drastic energy reduction or high surface areas. Simple flame tests revealed that the MA process alters ignitability, as all Al-PTFE MA composites ignited readily upon application of a butane flame, while physical mixtures of micrometer precursor powders were only ignitable with continued flame exposure. To elucidate composite particle reactivity and gain insight into their ignition characteristics, DSC-TGA experiments were conducted to compare composite reaction with that of unmilled precursor and nAl-nPTFE mixtures.

Figure 6:
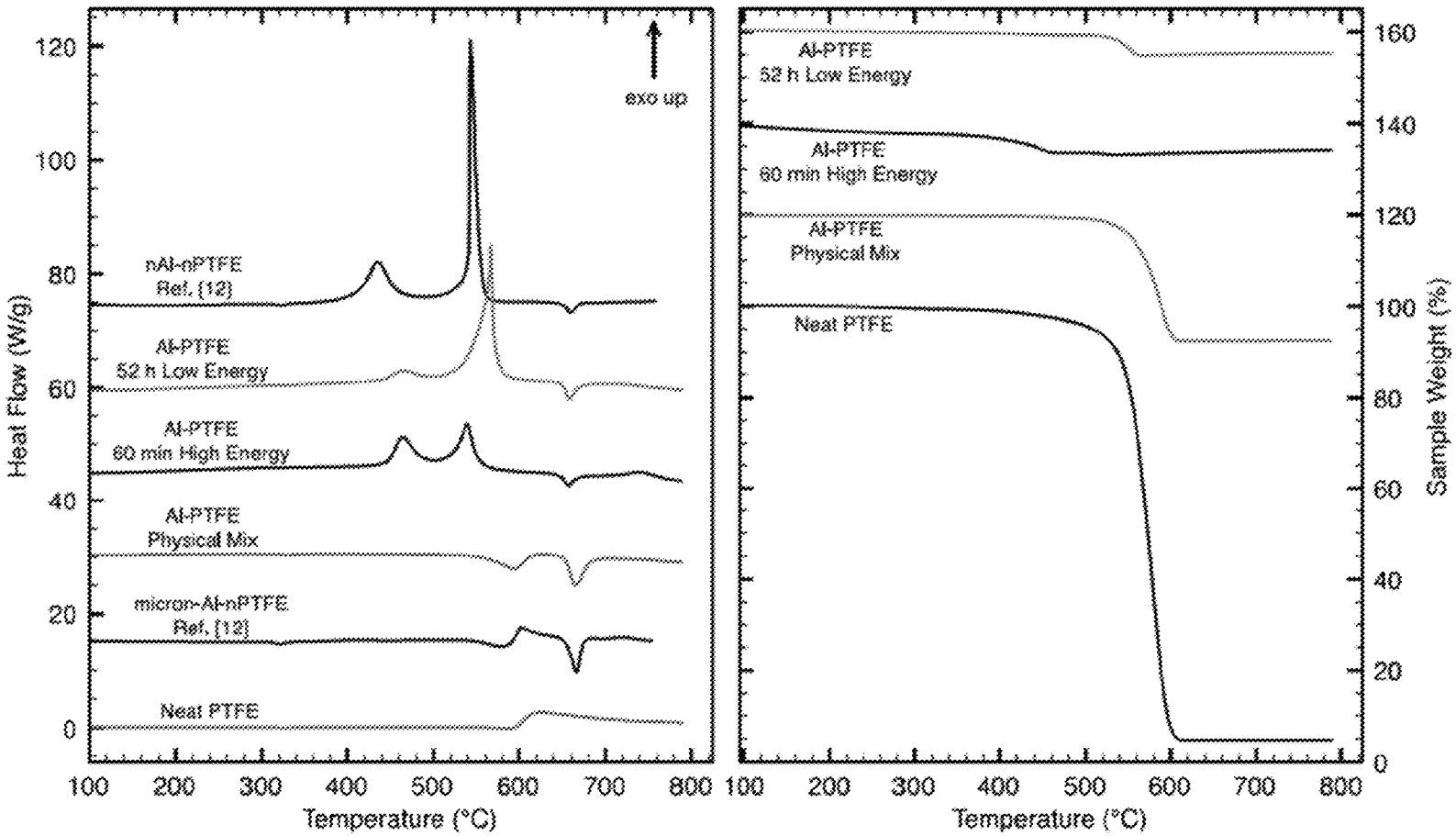
FIG. 6 is a graphical presentation of DSC (20 K/min, argon) heat flow (left) and sample weight history (right) of Al-PTFE (70-30 wt. %) reactive composite in accordance with embodiments of the invention compared to results of Osborne and Pantoya. Heat flow signals were shifted 15 W/g and weight signals were shifted 20% for presentation.

First, the reaction of Al-PTFE particles by analysis under argon atmosphere is considered (FIG. 6). In heating of micrometer physical mixtures, melting of PTFE near 327° C. followed by PTFE decomposition (onset about 500° C.) and sample weight loss were observed. Decomposition of PTFE occurred rapidly until about 600° C. at which point nearly all the PTFE (27% of sample weight) was decomposed. This first step of the Al-PTFE reaction is decomposition of PTFE into gaseous products. As PTFE decomposition ceased (615° C.), a weak exotherm occurred and finally at 660° C. melting of unreacted aluminum occurred. In micrometer physical mixtures, only a small portion of PTFE reacted with aluminum, as is evident by the weak exotherm and prominent aluminum melt exotherm. This is a result of a lack of reaction interfacial area, as slightly greater exothermicity occurred in reaction of micrometer Al with nPTFE, as shown in FIG. 6. However, reaction of both of these mixtures is limited to about temperatures of 550-640° C. where PTFE decomposition occurs. The degree of reaction occurring in these mixtures is also low, as aluminum melt endotherms are prominent.

However, this is not the case for MA composite particles, which undergo a reaction that is more representative of nAl-nPTFE (FIG. 6) in which the occurrence of a pre-ignition reaction (PIR) at about 430° C. followed by a primary exotherm at about 540° C. has been observed. Considering first the low energy MA composite particles, PTFE melting at 327° C. was observed. During low temperature heating of composite particles, interparticle strain may occur, as the coefficient of linear thermal expansion of PTFE is about 10 times higher than that of aluminum. In heating from room temperature to melting temperature (327° C.), PTFE volumetrically expands by 36%, causing particles to strain, exposing unoxidized aluminum surfaces. Following PTFE melting, an exothermic PIR reaction onsets at about 450° C., which is far below the reaction temperature of micrometer physical mixtures. This PIR reaction occurred in the condensed phase without significant weight loss and is a result of exothermic fluorination of alumina. Exothermic fluorination was immediately followed by rapid weight loss caused by PTFE decomposition. During this process, PTFE product gases generated throughout composite particles may raise the pressure inside the particles, further increasing particle stress until aluminum and PTFE surfaces debond, allowing PTFE decomposition gases to react at aluminum surfaces and to escape. Due to the high milling-induced interfacial surface area within particles, reaction can occur much faster than in micrometer mixtures and leads to more efficient use of PTFE decomposition products. Additionally, the reaction rate is increased by the higher species diffusivity caused by milling. A second (primary) exotherm then onsets near 520° C. and causes rapid exothermic reaction. This exotherm is initiated by two simultaneous, exothermic phase transformations in which amorphous $Al_2O_3$ is converted to $\gamma$-$Al_2O_3$ and $\beta$-$AlF_3$ to $\alpha$-$AlF_3$. During the onset of these two phase transformations, heat release causes decomposition of remaining PTFE and successive reaction with aluminum. Aluminum fluorination may be further facilitated by the exposure of aluminum surfaces due to breakup of the $Al_2O_3$ passivation layer caused by densification of $Al_2O_3$ in transition from the amorphous to $\gamma$-phase.

A similar two-step exothermic behavior was observed in the heating of high energy MA composites. An exothermic PIR reaction onset at about 440° C. accompanied by a 5% sample weight loss resulting from PTFE decomposition. The PIR reaction then occurred and was followed by a main exotherm that onset at about 510° C. However, the onset temperatures of the PIR and main exotherm vary slightly from those observed from low energy MA composites due to the varying degree of intermixing caused by the different milling conditions. Additionally, the magnitude of the high energy MA composite PIR was substantially greater than that of low energy MA composites. Following the PIR and main exotherm, a weak aluminum melting endotherm occurred at 660° C. and finally, an additional, weak, "late second exotherm" (approx. 740° C.) that is believed to be aluminum oxide phase transformations from $\gamma$-$Al_2O_3$ to $\delta$-$Al_2O_3$ and/or $\theta$-$Al_2O_3$.

While DSC experiments in argon allowed assess of MA effects on Al-PTFE interaction, experiments in the presence of an additional oxidizer species were more representative Of the environment (e.g., composite propellants, enhanced blast, etc.) in which these fuel rich (70 wt. % Al) particles will be used. Therefore, additional DSC-TGA experiments were conducted at various heating rates in presence of 20 vol. % $O_2$—Ar. In DSC heating of physical, micrometer mixtures (FIG. 7), an exotherm and corresponding rapid sample weight loss occurred around about 530-580° C., which was caused by PTFE decomposition and reaction with oxygen. This was confirmed by heating neat PTFE in $O_2$—Ar and is consistent with the reaction mechanism proposed by Losada and Chaudhuri [Theoretical Study of Elementary Steps in the Reactions Between Aluminum and Teflon Fragments under Combustive Environments, *J. Phys. Chem. A.* 2009, 113, 5933-594126] and measurements made by Zamkhov et al. [Ultrafast Chemistry of Nanoenergetic Materials Studied by Time-Resolved Infrared Spectroscopy: Aluminum Nanoparticles in Teflon, *J. Phys. Chem. C.* 2007, 11, 10278-10284] that showed Al-PTFE reaction pathways beginning with $O_2$-PTFE decomposition species are more favorable (e.g., lower activation energy, higher exothermicity) and faster than anaerobic pathways. Consequently, in the case of DSC heating of physical Al-PTFE mixtures, about all observed heat release was attributed to PTFE decomposition products reacting with oxygen and any Al-PTFE interaction was obscured. This lead to a strong aluminum melting endotherm at 660° C., which is approximately the same magnitude as the melt endotherm caused from the heating of neat aluminum. Heating behavior of low energy MA composites was similar to physical mixtures but was more exothermic. However, in low energy MA composites, the exotherm temperature decreased to about 520-580° C. due to the intimate mixing afforded by low energy MA.

Figure 7:
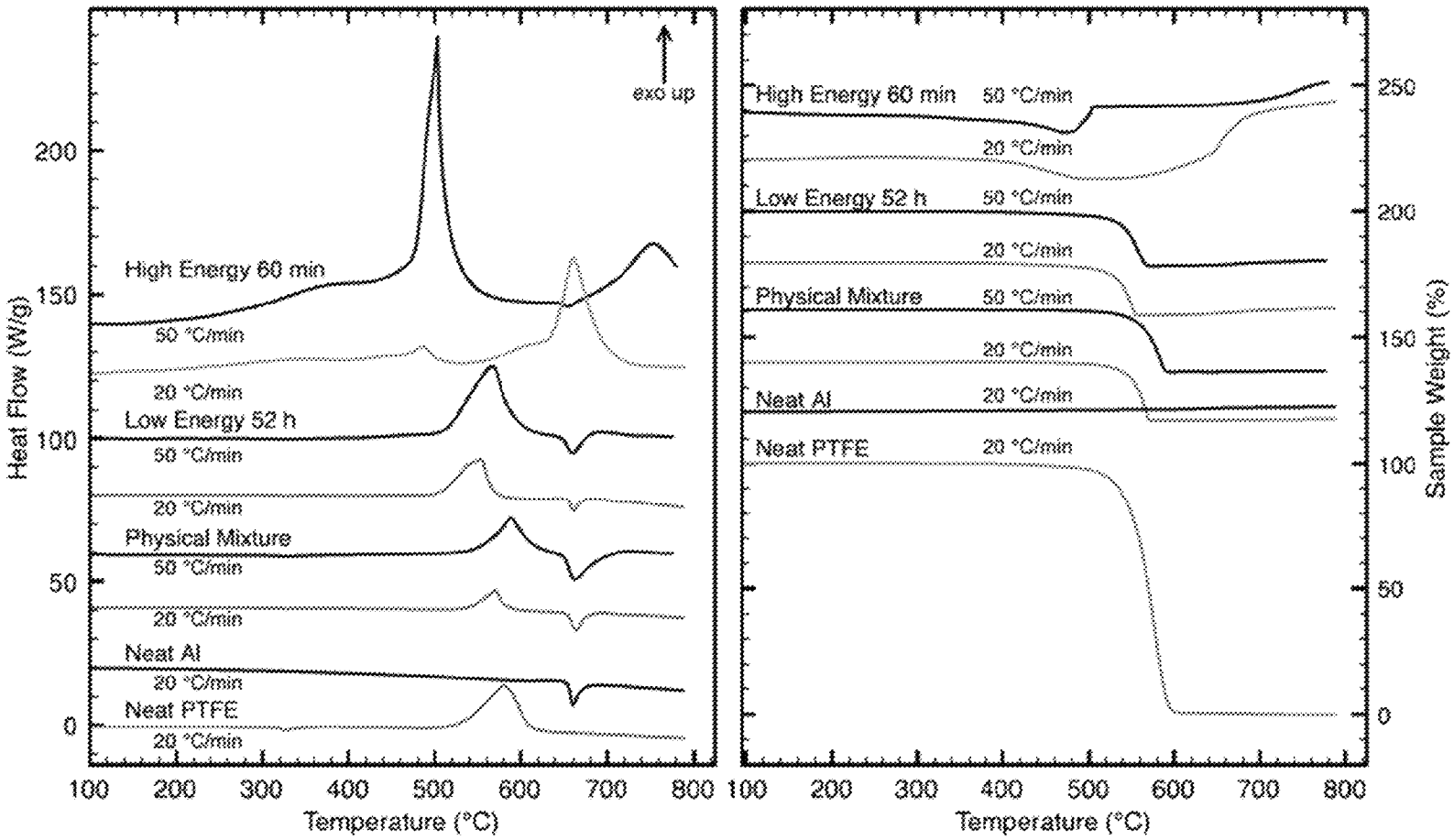
FIG. 7 is a graphical presentation of heat flow (left) and sample weight history (right) of Al-PTFE (70-30 wt. %, 20 vol. % $O_2$—Ar) composite particles in accordance with embodiments of the invention and 35 μm neat aluminum and 35 μm neat PTFE. Heat flow signals were shifted 20 W/g and weight signals were shifted 20% for presentation.

In contrast to low energy MA particles, high energy MA (60 min) particles exhibit far different behavior when heated in $O_2$—Ar (FIG. 7). Upon heating (20° C./min), a broad, low temperature exotherm (which onsets at 225° C.) was observed. This heat release was likely due to some HDPE contamination from the milling container, as this behavior was not observed when milling was conducted in polypropylene containers. A second exotherm onset at approx. 460° C. that corresponds to the previously described PIR. This exotherm was accompanied by an 8% sample weight loss that was likely due to both PTFE decomposition and exothermic reaction of decomposition products with aluminum and oxygen. A third exotherm accompanied by sample weight gain broadly onset near 550° C. and was initiated by the two exothermic $Al_2O_3$ and $AlF_3$ phase transitions observed in argon DSC, discussed previously. This heat release, which was a result of PTFE decomposition products and oxygen reacting with aluminum, greatly accelerated during the melting of aluminum and peaks at 660° C. At this point, near complete reaction of aluminum was indicated by the lack of an aluminum melt endotherm. At a 50° C./min heating rate, a broad, low temperature exotherm was also observed at 225° C. At this heating rate, the first major exotherm onset corresponds to the previously described PIR (approx. 440° C.). This reaction resulted in near complete aluminum oxidation (and greater heat release) as evident from the corresponding 10% weight gain and a weak aluminum melting endotherm observed at 660° C. Aluminum melting was followed by a late second exotherm and further weight gain (oxidation) of 7%.

The maximum heat flow from high energy MA composite particles (approx. 100 W/g) was substantially higher than physical mixtures or low energy MA particles (approx. 20 W/g) at 50° C./min. In addition to higher exothermicity, the absence of aluminum melting endotherm in the heating of high energy MA composite particles at 20° C./min indicates a greater extent of aluminum reaction. Furthermore, comparison of the heating of high energy MA composites to that of 35 mm neat aluminum particles shows the drastically modified behavior of aluminum combustion caused by MA of these fuel rich composite particles.

Micrometer-sized activated fuel particles, as described above and in accordance with the invention and which exhibit altered ignition and reaction characteristics are a promising alternative to nanoparticle solid propellant additives such as nAl. With these particles, similar propellant performance increases can be achieved with less detriment to propellant mechanical and rheological properties. Further, when used as a replacement in solid propellants, these particles may ignite far below the ignition temperature of micrometer-sized aluminum (>2000° C.) and they may decrease ignition delay, agglomerate size, and reduce condensed phase losses as well as lead to increased heat release and higher burning rates. Use of these fuel rich Al-PTFE composite particles in structural energetics (e. g. reactive liners), flares, incendiaries and other energetics could also likely lead to performance characteristics that far exceed that of energetics made from physical mixtures of micrometer or nanometer particles.

In alternative embodiments, other fluorocarbon oxidizers can be used for ignition and combustion of these activated fuel particles at high heating rates. Furthermore, these materials can be incorporated into solid and hybrid propellants and structural reactives.

Thus the invention provides fuel rich aluminum (Al) fluorocarbon (at least about 70 wt. % aluminum and up to about 30 wt. % fluorocarbon, e.g., polytetrafluoroethylene (PTFE), poly(carbon monofluoride) (PMF) or other) reactive composites formed via mechanical activation (MA). Disruption of ignition barriers and control of the reaction rate is achieved by use of MA. In addition, a lower stability, pre-strained fluorocarbon (PMF) results in a material that is highly tunable in terms of onset ignition temperature and has variable exothermicity that can be increased by a factor of nine through adjustment of milling parameters and passivation. The reaction can also be tuned to produce either condensed or gas phase products. The heat release from MA treated composites can be higher than that of physical nanoparticle mixtures based on differential scanning calorimetry (DSC). Net heat release of MA treated Al-PMF and Al-PTFE composites of 4.6 and 4.2kJ/g, respectively, are two and 1.75 times higher than the net heat release of physical mixtures of nano-aluminum and nano-PTFE of prior art. In both Al-PTFE and Al-PMF, the heat release from defect relaxation during heating can be substantial. Mechanical activation of the Al-PMF and alumina addition via passivation can reduce exotherm onset to less than 300° C. in contrast to physical mixtures that exotherm at about 650° C. The optical flash ignitability of the Al-fluorocarbon reactives is further described below.

In addition to possible improvements in the performance of propellants, explosives, and pyrotechnics, the composites herein provided are also capable of being ignited through low energy optical stimulus such as a photographic (camera) flash. Flash ignitability of the material makes it useful for a variety of novel applications requiring optical/laser ignition such as remotely initiated explosives and optically initiated igniter materials such as are capable of decreasing the startup transient of a solid rocket motor. The materials are also useful in other applications in which rapid ignition (such as possibly from an optical source) are desired.

Figure 8:
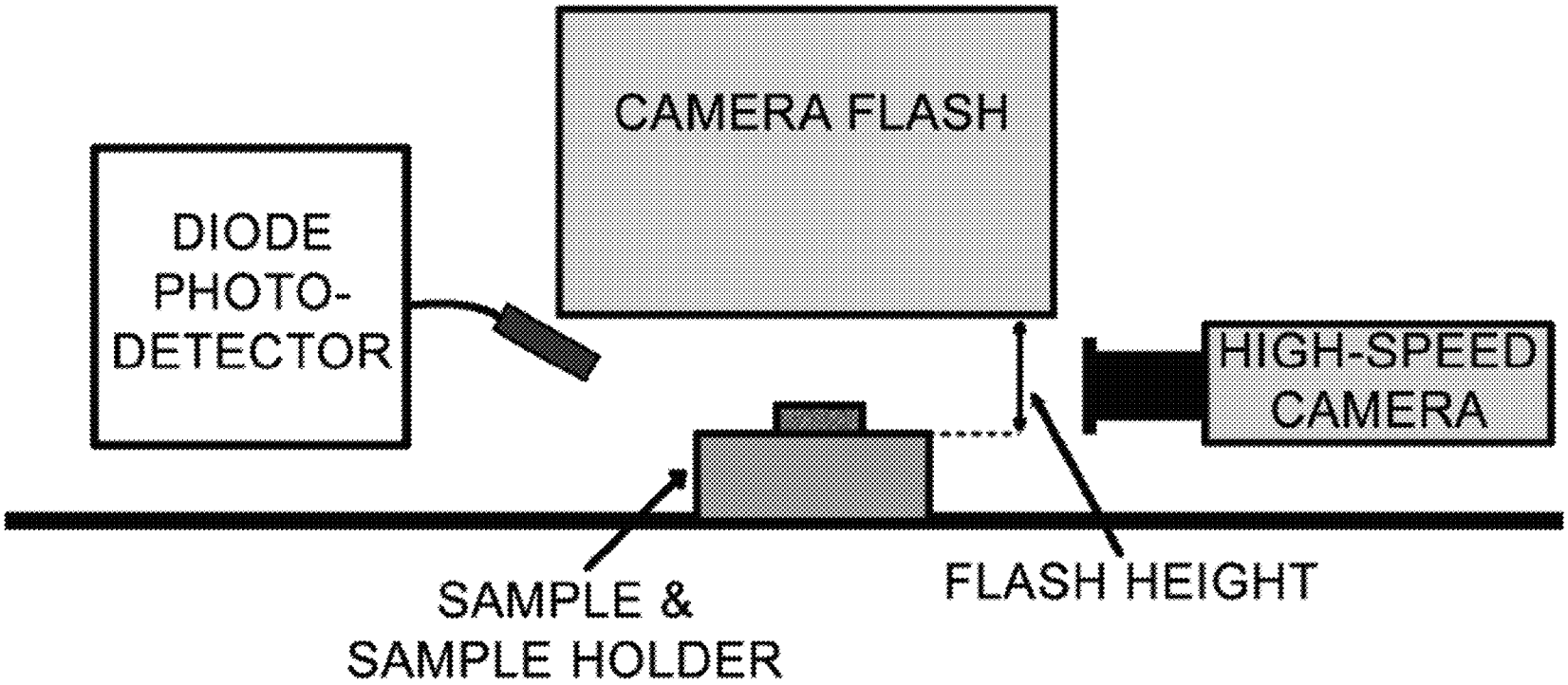
FIG. 8 is a simplified schematic of the flash ignition experimental setup used in the examples.

Optical flash ignition of the mechanically activated material was conducted using a flash ignition experimental setup as shown in FIG. 8 and generally designated by the reference numeral 100. The flash ignition experimental setup 100 included a sample holder 110, a diode photo detector 114, a camera flash 118 and a high speed camera 120. A sample, designated by the reference numeral 124 was placed and positioned on the sample holder 110.

Briefly, a series of 10 mg samples of the mechanically activated composite material were placed in an 8 mm diameter, tap density configuration atop an aluminum tray (SPEX 3619A). The tray was centered under a Nikon Speedlight SB-24 camera flash (ISO100, flash duration 0.25 ms, F1.4, zoom 85 m) at a distance of 10.9 mm from the particles. Video of the ignition event was recorded at 10,000 frame/s using a Vision Research Phantom V7.3 camera. Emission was recorded using a fiber optic attached to a ThorLabs DET10A (1 ns rise time) photodiode. Composite particle ignition delays were calculated as the time lapse between camera flash first light and deviation of the diode signal from a baseline (no material) signal. Delays were compared to the ignition delay of nAl/nPTFE physical mixtures prepared according to the prior art.

Flash ignition was achievable at heights below 10.9 mm for the Al-PMF material with a delay of about 2 ms, which is similar to the delay of nAl-nPTFE physical mixtures. In contrast, physical mixtures of Al-PMF, Al-PTFE, and milled Al-PTFE were generally not flash-ignitable.

Ignition delays were measured at 10.9 and 6.9 mm for Al-PMF(52-hr) and nAl-nPTFE. At a height of 15 mm, nAl-nPTFE ignited but Al-PMF (52-hr) failed to ignite. The ignition delay of both Al-PMF(52-hr) and nAl-nPTFE were approximately 1.7-2.0 ms and varied little with height. The ignition of Al-PMF was characterized by an initial gas release at an elapsed time of 1.2 ms and resulted in a dispersion of the reactive particles. A bright, orange flame developed after 3.3 ms and eventually decreased in intensity after 15 ms, giving way to what appeared to be burning particles on the order of 100 μm in size. In comparison, flash ignition of nAl-nPTFE physical mixtures resulted in a more uniform dispersion of fine particles and more intense emission. However, the nAl-nPTFE combustion produced visibly finer burning particles. The micron sized hot particles can be expected to be better for ignition of secondary materials than the small particles produced by nAl-nPTFE. Additional modifications could make such reactives particularly useful in many other energetic material applications with the tailorable capabilities of Al-PMF shown. For example, having PMF or other oxidizers incorporated inside of aluminum fuel particles in solid propellants could dramatically change particle ignition and combustion.

Those skilled it the art and guided by the teaching therein provided will understand and appreciate that reactive composite such as herein described and hereby provided can serve as desirable replacements for metal particles in solid propellants, pyrotechnics, explosives and other similar or related energetics.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for making mechanically activated metal fuels for energetic material applications, said method comprising:

mechanically treating micrometer-sized particles of at least one metal with particles of at least one fluorocarbon to form composite particles containing the at least one metal and the at least one fluorocarbon in unreacted form, wherein the composite particles contain the at least one metal in a realitve amount of at least about 70 wt. % and wherein the composite particles contain the at least one fluorocarbon physically encased within particles of the at least one metal.

2. The method of claim 1 wherein the at least one fluorocarbon is a high fluorine content material devoid of oxygen.

3. The method of claim 1 wherein the at least one fluorocarbon is selected from the group consisting of polytetrafluoroethylene, poly(carbon monofluoride), 1-chloro-1,2,2-trifluoroethene, terpolymers based on tetrafluoroethylene, hexafluoropropylene and vinylidene fluoride, and combinations thereof.

4. The method of claim 1 wherein the at least one metal is selected from the group consisting of aluminum, boron, magnesium, silicon, lithium, and combinations or alloys thereof.

5. The method of claim 1 wherein said mechanical treatment comprises repeated plastic deformation of a mixture containing the micrometer sized particles of the at least one metal and particles of the at least one fluorocarbon.

6. The method of claim 1 wherein said mechanical treatment comprises milling.

7. The method of claim 6 wherein said milling comprises high energy milling.

8. The method of claim 6 wherein said milling comprises low energy milling.

9. The method of claim 1 wherein said mechanical treatment creates energy storing lattice defects within the composite particles.

10. The method of claim 1 wherein the composite particles contain the at least one fluorocarbon in a relative amount of up to about 30 wt. %.

* * * * *